United States Patent [19]

Clar

[11] 4,364,440

[45] Dec. 21, 1982

[54] HAND HELD ROTARY IMPACT TOOL

[76] Inventor: Milton Clar, 9408 Linden Ave., Bethesda, Md. 20014

[21] Appl. No.: 148,051

[22] Filed: May 8, 1980

[51] Int. Cl.[3] ..... B25D 15/00

[52] U.S. Cl. ..... 173/93.7; 81/466

[58] Field of Search ..... 173/93.7, 109; 81/463, 81/466

[56] References Cited

U.S. PATENT DOCUMENTS

| | | | |
|---|---|---|---|
| 2,524,155 | 10/1950 | Allen | 173/93.7 |
| 2,633,042 | 3/1953 | Halverson | 173/93.7 |
| 2,638,806 | 5/1953 | Spielman | 173/93.7 |
| 2,638,807 | 5/1953 | Sharman | 173/93.7 |
| 2,833,173 | 5/1958 | Aspeek | 173/93.7 |

*Primary Examiner*—Werner H. Schroeder
*Assistant Examiner*—Andrew M. Falik
*Attorney, Agent, or Firm*—Shapiro and Shapiro

[57] ABSTRACT

A rotary impact tool such as a socket wrench has an anvil member at one end of a shaft for providing rotary movement to a tool body, and a striker non-rotatably and slidably mounted on the shaft for impacting the anvil member and imparting rotational forces thereto through complementary inclined striking surfaces on the anvil member and striker, respectively. The anvil member is mounted for limited rotational movement on the shaft between first and second extreme positions and can be biased to one or other of such positions to properly orientate the respective striking surfaces of the anvil and striker members.

14 Claims, 8 Drawing Figures

HAND HELD ROTARY IMPACT TOOL

BACKGROUND OF THE INVENTION

This invention relates to a rotary tool, such as a socket wrench or screwdriver, in which axial impact of a striker against an anvil member applies a rotational force to the anvil member in order to apply torque to a tool body associated with the anvil member. Such tools are useful in applications where it is necessary to augment the normal manual torque which can be applied by the tool, for example, in the removal of overtightened bolts, screws, nuts and the like.

Typically, in rotary impact tools of the above-type, an axial impact between the striker and anvil member applies a rotational force to the anvil member by means of complementary inclined striking surfaces formed on the striker and anvil member respectively, and commonly, oppositely handed sets of such surfaces are provided on the respective members so that rotary forces in either sense can be applied to the anvil member by suitably aligning the anvil member and striker to bring the relevant set of surfaces into engagement upon impact.

In one previously proposed rotary impact tool of the type described, the anvil member is fixed on the end of an elongate rod or shaft and the striker is rotatably and slidably mounted on the shaft above the anvil member. To obtain rotational movement of the anvil member when impacted by the striker, the striker is manually orientated on the shaft so as to mutually misalign the striking surfaces of the anvil member and striker and the striker is allowed to drop or is forcibly urged against the anvil member. With this arrangement, since the striker is freely rotatable on the shaft and is oriented manually by sight, it is possible that it may not accurately strike the anvil member in a manner producing optimum torque between the respective inclined surfaces and further, on impact, rotation may be induced in the striker rather than in the anvil member.

In another previously proposed tool, the anvil member is again fixed on the base of an elongate shaft, in this case of rectangular cross section, and the striker is oriented relative to the shaft by radial pins resiliently urged against the flat outer surfaces of the shaft. The striker can be rotated relative to the shaft, to change the direction of rotation imparted to the anvil member, by resilient movement of the pins, but with this arrangement, on impact of the striker against the anvil member, and rotation of the anvil member and shaft, the resilience in the connection between the striker and the shaft may tend to alter the orientation of the striker on the shaft which may again lead to inaccurate impacts which do not produce optimum torque.

SUMMARY OF THE INVENTION

It is an object of the present invention to provide a rotary impact tool having a striker, an anvil member and complementary surfaces on the anvil member and striker respectively for applying rotary forces to the anvil member upon impact thereof by the striker, wherein the tool incorporates novel means for orienting the anvil member and striker to obtain proper engagement of the respective striking surfaces.

Another object of the invention is to provide a tool as set forth in the preceding paragraph having alternative settings for applying rotational forces to the anvil member in one or other sense when impacted by the striker.

A further object of the invention is to provide a rotary impact tool having an anvil member carried at one end of a shaft, for turning a tool body, a striker for impacting the anvil member and producing rotational movement thereof through complementary inclined surfaces on the anvil member and striker, wherein the striker is non-rotatably mounted relative to the shaft and the anvil member has limited rotational movement relative to the shaft, so that proper orientation of the respective striking surfaces can be obtained.

Still another object of the invention is to provide a rotary impact tool having alternative settings in which rotary motion can be imparted to an anvil member in opposite directions, respectively, the tool having economical and simple-to-operate means for effecting adjustment between the alternative settings.

Still another object of the invention is to provide a rotary impact tool in which the anvil member is resiliently biased to a position establishing proper orientation between the respective striking surfaces of the anvil member and striker.

With the above and other objects in view, the invention provides a rotary impact tool suitable for use as a wrench, screwdriver or the like, comprising an elongate shaft, an anvil member carried at one end of the shaft for attachment to a tool body and a striker non-rotatably and axially slidably mounted on the shaft for impacting the anvil member and applying rotational forces thereto through complementary inclined striking surfaces formed on the anvil member and striker, respectively. The striking surfaces are formed in oppositely handed pairs so that rotational forces in either direction can be applied to the anvil member dependent on the relative orientation of the anvil member and striker, and the anvil member has selective rotational movement relative to the shaft between opposed extreme positions. In its one extreme position on the shaft, the anvil member is orientated relative to the striker to effect rotary motion in one direction by engagement of the one set of complementary striking surfaces and in its other extreme position on the shaft the anvil member is orientated relative to the striker to effect rotary motion in the opposite direction by engagement of the other set of striking surfaces.

In one preferred form of the invention, the shaft has a radial pin projecting through opposed openings in the anvil member and with a clearance between the pin and the opening defining the limits of rotation of the anvil member relative to the shaft. The anvil member further includes a pair of diametrically opposed projections located between the projecting ends of the pin. A pair of endless elastic bands of suitable length are engaged over the respective pin ends and the projections to resiliently urge the anvil member into one of its extreme rotational positions relative to the shaft. When impacted by the striker, the anvil member can rotate relative to the shaft within its limits of movement and against the resilient force of the endless bands. By swapping over the bands, as between the respective pin ends and anvil member projections, the anvil member can be urged to its opposite extreme position to properly orient the other set of striking surfaces and effect reverse rotation of the anvil member when impacted by the striker.

The above-described arrangement provides a simple and effective means, in a rotary impact tool of the type described, for properly orienting the respective striking surfaces of the anvil member and striker and for changing the setting of the tool between alternative positions for applying torque in opposite directions.

A preferred embodiment of the invention will now be described by way of example only, with reference to the accompanying drawings.

DESCRIPTION OF THE PREFERRED EMBODIMENT

Figure 7:
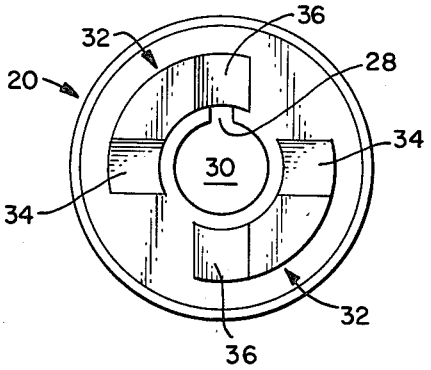
FIG. 7 is a view on the undersurface of a striker member of the wrench.
Figure 8:
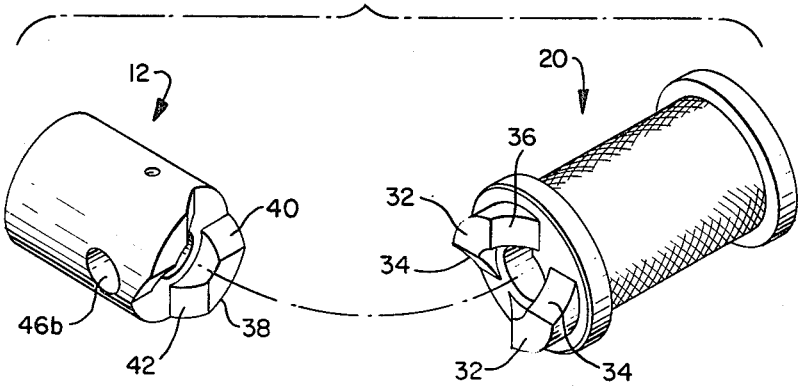
FIG. 8 is an exploded perspective view of the anvil member and striker member.

The illustrated wrench consists basically of an elongate mounting member which may take the form of a circular shaft 10, a tubular anvil member 12 carried at one end of the shaft, the anvil member having a conventional square 14, with a sprung detent 16 for attachment of a socket 18 or like tool body, a tubular striker member 20 longitudinally slidably mounted on the shaft, and an operating handle 22 and striker stop 24 at the end of shaft 10 remote from anvil member 12. Stop 24 is positioned to prevent striker 20 from pinching an operator's fingers when it is drawn up the shaft. Typically, the shaft has a length of about 12 to 15 inches and the striker 20 has a weight of about 1½ pounds. Shaft 10 has a longitudinal key 26 and a corresponding keyway 28 is formed in a circular bore 30 (see FIG. 7) in the striker, so that the striker can slide longitudinally but non-rotatably on the shaft. As indicated, the striker is bobbin-shaped and has a knurled outer surface to facilitate its manipulation.

In use, striker 20 is allowed to drop or is forced against the anvil member 12 to produce an impact which applies a rotational force to the anvil member. To this end, the lower face of the striker has projecting dogs 32 each with oppositely inclined striking surfaces 34 and 36, respectively, and the upper end of anvil member 12 is formed with like dogs 38 each also having oppositely inclined striking surfaces 40 and 42 complementary to surfaces 34 and 36. It will be understood that when anvil member 12 and striker 20 are mutually orientated such that surfaces 34 strike surfaces 40 upon impact of the striker with the anvil member, a clockwise rotational force will be applied to the anvil member, while if the elements are mutually orientated such that surfaces 36 strike surfaces 42, a counterclockwise rotational force will be applied to the anvil member.

At its lower end, shaft 10 has a radial pin 44 which projects into and through opposed circular openings **46*a*, 46*b* in anvil member 12, each of the openings communicating with a central circular bore in the anvil member. The anvil member is retained on the end of shaft 10 solely by pin 44, and a clearance between the openings 46*a* and 46*b* and the ends of pin 44 affords limited rotational movement and also limited axial movement of anvil member 12 relative to shaft 10. Further, the alignment of pin 44 is such that when anvil member 12 is in its one extreme, or terminal position of rotation on shaft 10, surfaces 34 and 40 are mutually orientated for striking engagement, while when anvil member 12 is in its other extreme, or terminal position, surfaces 36 and 42** are mutually orientated for striking engagement.

Figure 1:
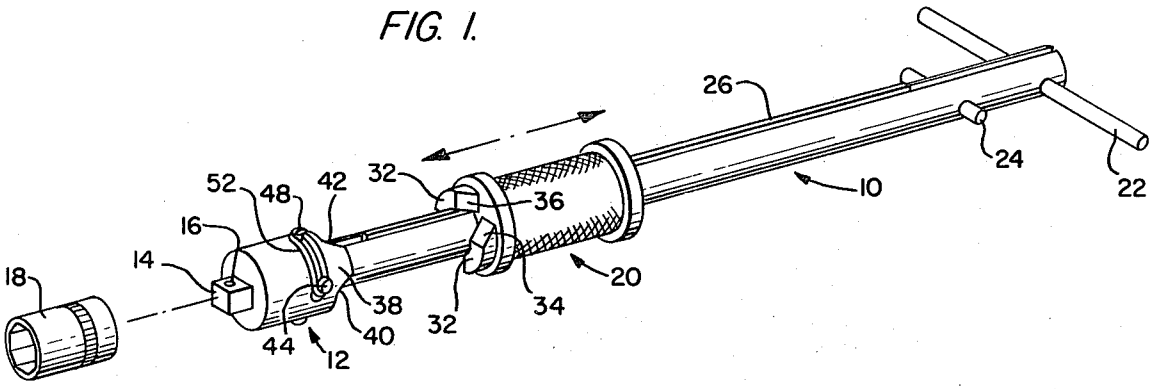
FIG. 1 is a perspective view of a rotary impact wrench in accordance with the invention.
Figure 2:
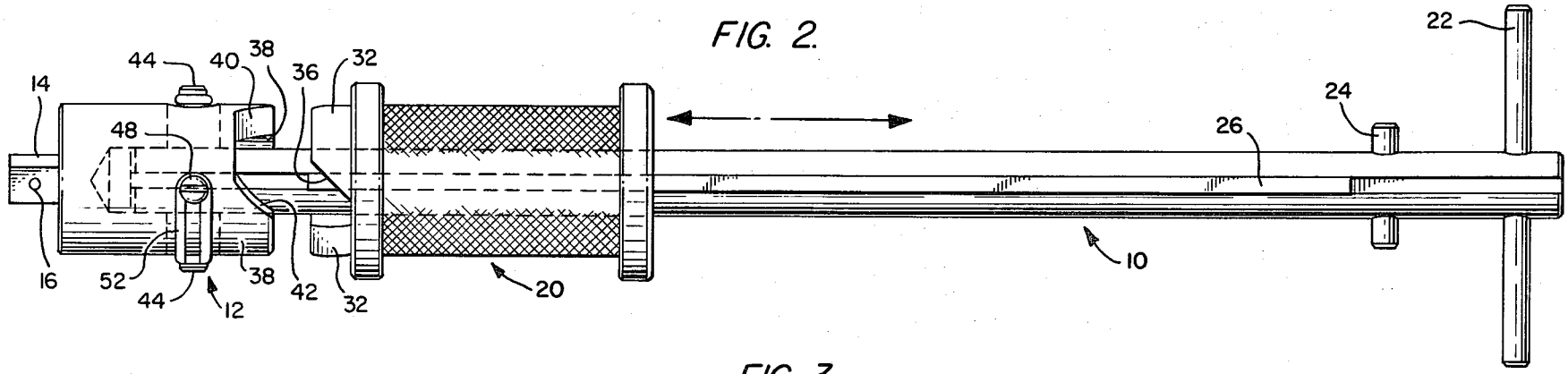
FIG. 2 is a front elevational view of the wrench.
Figure 3:
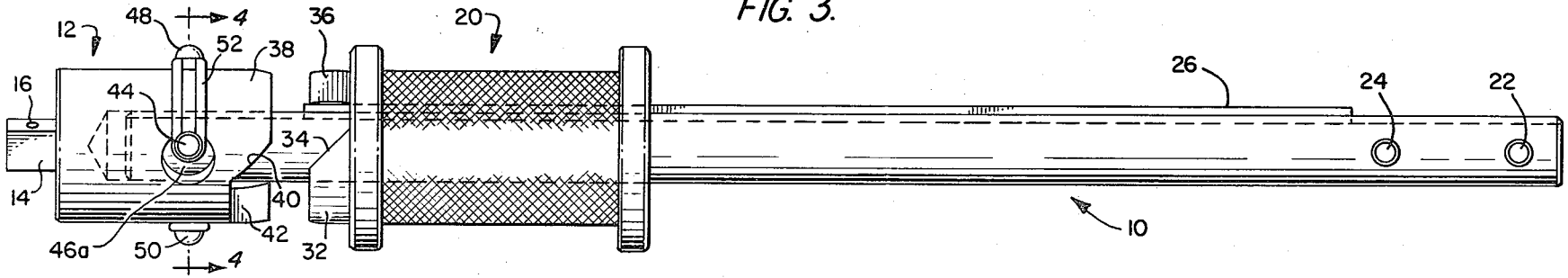
FIG. 3 is a side elevational view of the wrench.
Figure 4:
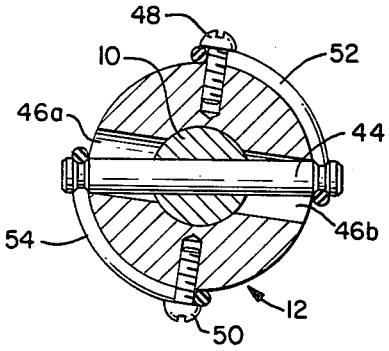
FIG. 4 is a cross section on line 4—4 of FIG. 3 showing an anvil member of the wrench biased to one extreme position.
Figure 5:
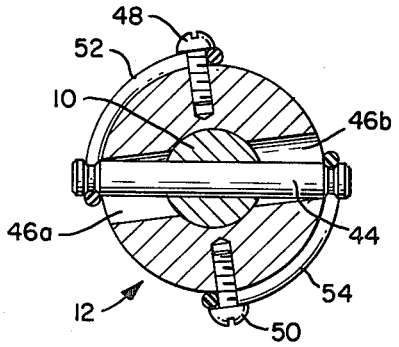
FIG. 5 is a view similar to FIG. 4 showing the anvil member biased to its other extreme position.
Figure 6:
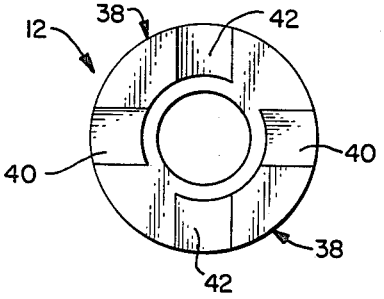
FIG. 6 is a view on the top surface of the anvil member.

Anvil member 12 is further provided with radially projecting screws 48 and 50 spaced substantially 90 degrees from the openings **46*a* and 46*b*. In use, endless elastic bands 52 and 54 are engaged over the respective projecting ends of pins 44 and the screws 48 and 50, to urge the anvil member into one or other of its extreme positions and thereby properly orientate one or other set of the striking surfaces. As shown clearly in FIGS. 4 and 5**, by swapping over the engagement of the bands as between the respective pin ends and screw heads, the orientation of the anvil member is changed between the respective extreme positions, so as to produce either clockwise or counterclockwise rotational forces on the anvil member through engagement of the relevant set of striking surfaces when the anvil member is impacted by the striker.

With the above-described arrangement, when the striker impacts against the anvil member, the anvil member is rotated relative to shaft 10 within its rotational limit and against the biasing action of bands 52 and 54. When the striker is disengaged, the bands return the anvil member to its initial extreme position. It will therefore be seen that a convenient and simple means is provided for properly orientating the anvil member relative to the striker and for adjusting the setting of the tool to apply rotational forces to the anvil in opposite directions. Further, the limited axial movement provided between the anvil member and the shaft produces a shock-absorbing effect when the anvil member is impacted by the striker, which minimizes wear on pin 44.

In a modified form of the tool, limited rotational movement between the anvil member and shaft is provided by means of a squared end section of the shaft which fits in a square-section bore in the anvil member of larger dimension than the shaft. With this arrangement, orientation of the striking surfaces of the anvil member and striker is obtained by manually rotating the shaft relative to the anvil member into one or other of its extreme positions as governed by the amount of clearance between the square-section of the shaft and the square-section bore in the anvil member.

While only preferred embodiments of the invention have been described in detail, it will be understood that the invention is not restricted to such detail and modifications can be made within the scope of the attached claims.

I claim:

1. A rotary impact tool comprising a shaft, an anvil member on said shaft for providing rotary motion to a tool body, a striker nonrotatably and axially slidably mounted on said shaft for applying impact forces to said anvil member by axial movement of said striker on said shaft, complementary inclined striking surfaces on said anvil member and said striker, respectively, and means permitting selective rotational movement of said anvil member relative to said shaft to and from a terminal position in which the respective striking surfaces of said anvil member and said striker are mutually orientated so that an axial impact of said striker against said anvil member applies a rotational force to said anvil member.

2. The tool as defined in claim 1, wherein said anvil member is mounted for rotational movement relative to said shaft between first and second terminal positions in which said anvil member and striker are mutually orientated to bring said striking surfaces into engagement producing a rotational force on said anvil member upon impact by said striker in opposite rotational directions respectively.

3. The tool as defined in claim 1, wherein said complementary inclined striking surfaces comprise a first pair of complementary surfaces on the anvil member and striker, respectively, for converting an axial impact force between the striker and anvil member into a clockwise rotational force on the anvil member and a second pair of complementary surfaces on the anvil member and striker, respectively, for converting an axial impact force between the striker and anvil member into a counterclockwise rotational force on the anvil member, said anvil member having a first terminal position relative to said shaft orientating said anvil member for bringing said first pair of surfaces into mutual striking engagement and said anvil member having a second terminal position relative to said shaft orientating said anvil member for bringing said second pair of surfaces into mutual striking engagement.

4. The tool as defined in claim 3 including biasing means for selectively urging said anvil member into either one of said first and second extreme positions.

5. The tool as defined in claim 1 or claim 3, wherein said means permitting selective rotational movement of said anvil member relative to said shaft comprises a radial pin extending from said shaft and an opening in said anvil member receiving said pin, said pin having clearance in said opening permitting limited rotational movement of said anvil member.

6. The tool as defined in claim 5, wherein said anvil member includes a first radial projection circumferentially spaced from said opening and said tool further includes resilient means engaged between said projection and an end portion of said pin for biasing said anvil member to one extreme rotational position relative to said shaft.

7. The tool as defined in claim 6, wherein said anvil member includes a further radial projection substantially diametrically opposed to said first radial projection, whereby said anvil member can be biased to either extreme rotational position relative to said shaft by engagement of said resilient means with said pin and a respective one of said projections.

8. The tool as defined in claim 7, wherein said resilient means includes at least one endless band.

9. The tool as defined in claim 1 including a handle means at the end of said shaft remote from said anvil member and a striker stop means adjacent said handle means.

10. The tool as defined in claim 1 or claim 3, wherein said anvil member is mounted for limited axial movement relative to said shaft.

11. A rotary impact tool comprising a shaft, an anvil member on said shaft for providing rotary motion to a tool body, a striker non-rotatably and axially slidably mounted on said shaft for applying impact forces to said anvil member by axial movement of said striker on said shaft, complementary inclined striking surfaces on said anvil member and said striker, respectively, means permitting selective rotational movement of said anvil member relative to said shaft whereby the respective striking surfaces of said anvil member and said striker can be mutually orientated so that an axial impact of said striker against said anvil member applies a rotational force to said anvil member, and biasing means urging said anvil member into a position on said shaft which provides engagement of the respective striking surfaces producing a rotational force on said anvil member upon impact by said striker.

12. A rotary impact tool having an elongate mounting member, an anvil member associated with the mounting member for providing rotary motion to a tool body, and a striker for applying impact forces to said anvil member by movement of said striker lengthwise with respect to said mounting member, said anvil member and striker having complementary inclined surfaces for providing rotation of the anvil upon impact by the striker, wherein said striker is non-rotatable relative to said mounting member and said anvil member has means providing limited rotational movement of the anvil member relative to said mounting member between a pair of predetermined terminal positions, in at least one of which positions the respective surfaces on the striker and anvil member are mutually oriented so that an axial impact of the striker against the anvil member applies a rotational force to the anvil member.

13. A rotary impact tool as defined in claim 12, wherein impact between the striker and anvil member provides clockwise rotational movement of the anvil member when the anvil member is in one of said terminal positions and impact between the striker and the anvil member provides counterclockwise rotational movement of the anvil when the anvil is in the other of said terminal positions.

14. A rotary impact tool having an elongate mounting member, an anvil member associated with the mounting member for providing rotary motion to a tool body, and a striker for applying impact forces to said anvil member by movement of said striker lengthwise with respect to said mounting member, said anvil member and striker having complementary inclined surfaces for providing rotation of the anvil upon impact by the striker, wherein said striker is non-rotatable relative to said mounting member and said anvil member has selective rotational movement relative to said mounting member between a pair of terminal positions, in at least one of which positions the respective surfaces on the striker and anvil member are mutually oriented so that an axial impact of the striker against the anvil member applies a rotational force to the anvil member, the tool including biasing means for selectively urging the anvil member into one or other of said terminal positions.

* * * * *